US007875817B2

(12) United States Patent
Matsuo

(10) Patent No.: US 7,875,817 B2
(45) Date of Patent: Jan. 25, 2011

(54) ELECTRONIC APPARATUS

(75) Inventor: Masatake Matsuo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 12/171,878

(22) Filed: Jul. 11, 2008

(65) Prior Publication Data

US 2009/0038919 A1 Feb. 12, 2009

(30) Foreign Application Priority Data

Aug. 10, 2007 (JP) ..... 2007-208728

(51) Int. Cl.
*H01H 9/20* (2006.01)

(52) U.S. Cl. ..... 200/50.32; 200/5 A

(58) Field of Classification Search ..... 200/5 A, 200/5 B, 552
See application file for complete search history.

(56) References Cited

U.S. PATENT DOCUMENTS 3,612,802 A * 10/1971 Beadle et al. ..... 200/329
3,870,840 A * 3/1975 Rivetta et al. ..... 200/5 A
4,188,137 A * 2/1980 Dannatt ..... 400/496
4,311,893 A * 1/1982 Tsuchiya et al. ..... 200/344
4,818,828 A * 4/1989 Curley et al. ..... 200/5 A
6,835,902 B2 * 12/2004 Hiraoka ..... 200/5 A
7,345,250 B2 * 3/2008 Hakunti et al. ..... 200/5 A
7,525,053 B2 * 4/2009 Babella ..... 200/5 A
7,547,857 B2 * 6/2009 Kim et al. ..... 200/520
7,671,291 B2 * 3/2010 Odanaka ..... 200/345

FOREIGN PATENT DOCUMENTS

JP 10-294044 11/1998

* cited by examiner

*Primary Examiner*—Renee Luebke
*Assistant Examiner*—Lisa Klaus
(74) *Attorney, Agent, or Firm*—Cowan, Liebowitz & Latman, P.C.

(57) ABSTRACT

An electronic apparatus includes plural operation buttons, through which each switch on a board can be compressed, and a connection part configured to connect two operation buttons out of the plural operation buttons with each other while maintaining the two operation buttons apart from each other, and to return a compressed operation button through an elastic force, wherein the connection part is arranged below an operation button that is located between the two operation buttons among the plural operation buttons.

8 Claims, 15 Drawing Sheets

ELECTRONIC APPARATUS

BACKGROUND OF THE INVENTION

1. Field of the Invention

The present invention relates to an electronic apparatus having plural operation buttons.

2. Description of the Related Art

A smaller configuration of an electronic apparatus having plural operation buttons is required as high performance and small electronic units have recently been increasingly demanded. The conventional electronic unit arranges plural operational buttons in a row and houses them in a narrow space.

For example, an electronic apparatus disclosed in Japanese Patent Laid-Open No. ("JP") 10-294044 combines a pair of components up and down, and fixes them in a case. Each component includes a stripe-shaped base, and plural operation buttons that each extend orthogonal to a longitudinal direction of the base, are supported by the base via support members, and are arranged at regular intervals in the longitudinal direction of the base. When the upper and lower components are combined, these operation buttons alternate in the longitudinal direction of the base. The case exposes the operation buttons, and the components are fixed into the case by inserting projections of the case is inserted into attachment holes of the base, and by bonding the base with the case.

In JP 10-294044, the base and the support member which projects beyond a key top as a top surface (or a compressed surface) of the operation button hinder a miniaturization of the electronic apparatus when the operation buttons are viewed from a direction perpendicular to their key tops. In addition, even in a direction perpendicular to the key top, a space is needed for two members, i.e., the base and the support member, because the components are combined up and down. Moreover, in inserting the projection of the case into the attachment hole of the base, the base and the support member deform and the operability of the operation buttons degrades. Furthermore, an adhesion between the base and the case is likely to peel off due to the stress applied during operations of the operation buttons.

SUMMARY OF THE INVENTION

The present invention is directed to provide a small electronic apparatus.

An electronic apparatus according to one aspect of the present invention includes plural operation buttons, through which each switch on a board can be compressed, and a connection part configured to connect two operation buttons out of the plural operation buttons with each other while maintaining the two operation buttons apart from each other, and to return a compressed operation button through an elastic force, wherein the connection part is arranged below an operation button that is located between the two operation buttons among the plural operation buttons.

An electronic apparatus according to another aspect of the present invention includes plural operation buttons, through which each switch on a board can be compressed, and two button units each having at least two operation buttons and a connection part configured to connect two operation buttons out of the plural operation buttons with each other while maintaining the two operation buttons apart from each other, wherein the two button units are combined so that the operation buttons of each button unit are alternately arranged, and wherein a connection part of one of the two button units is located below one of the at least two operation buttons of the other button unit of the two button units, and a connection part of the other of the two button units is located below one of the at least two operation buttons of the one button unit of the two button units.

Further features of the present invention will become apparent from the following description of exemplary embodiments (with reference to the attached drawings).

DESCRIPTION OF THE EMBODIMENTS

Referring now to the accompanying drawings, a description will be given of a digital camera (electronic unit) according to one embodiment of the present invention.

First Embodiment

Figure 1:
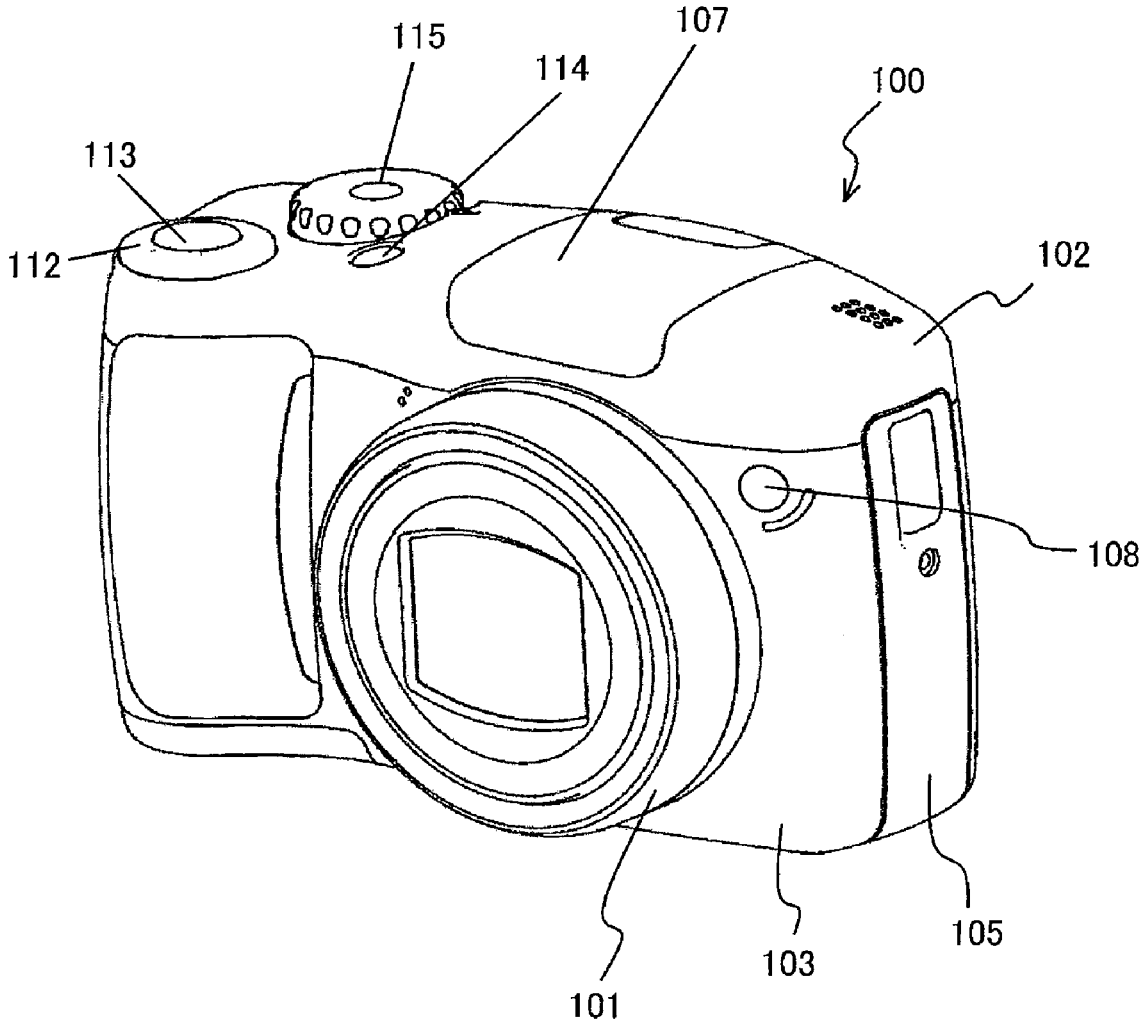
FIG. 1 is a perspective view of a digital camera (electronic unit) on its front surface side according to a first embodiment of the present invention.
Figure 2:
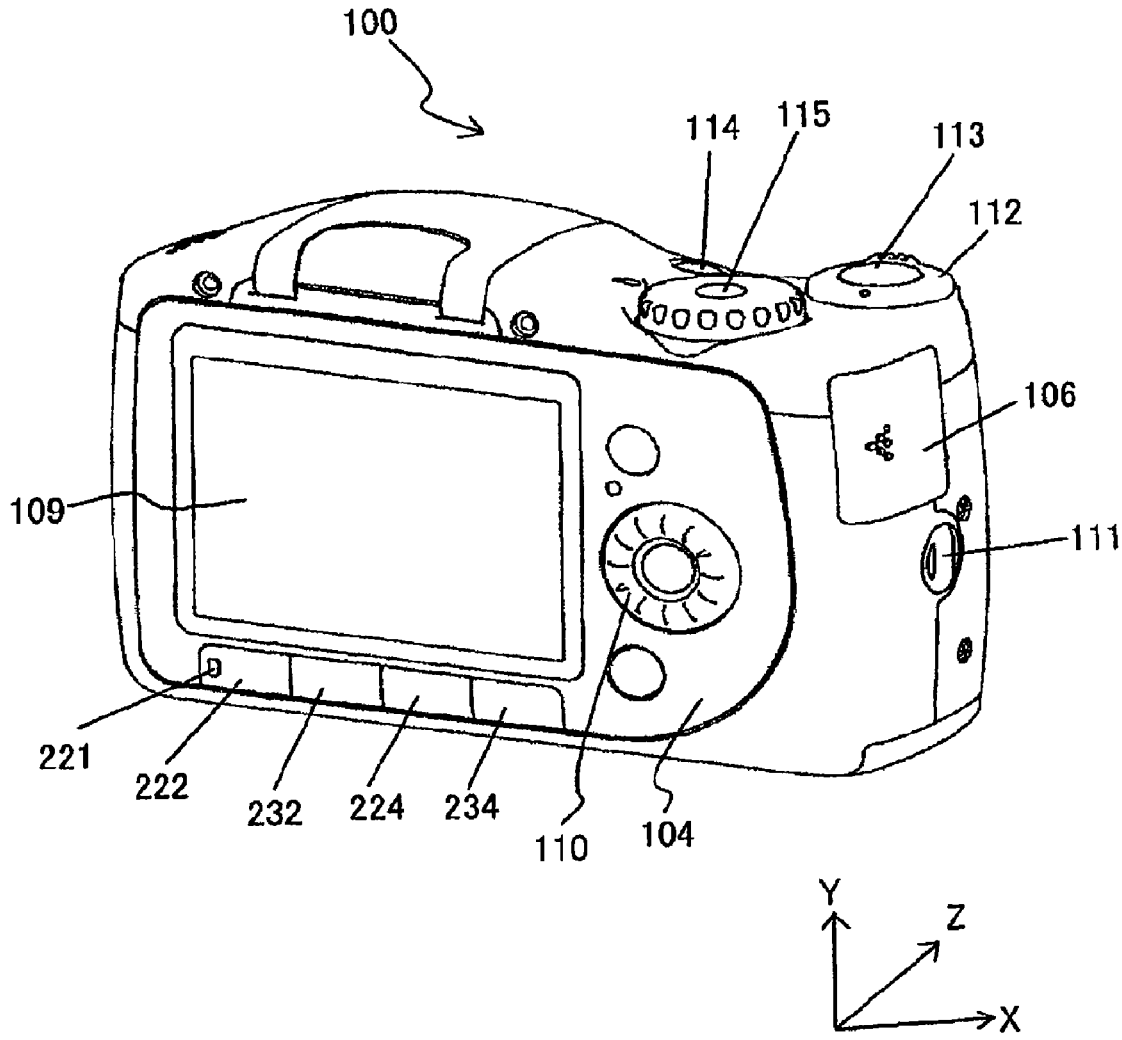
FIG. 2 is a perspective view of the digital camera shown in FIG. 1 on its rear surface side.
Figure 3:
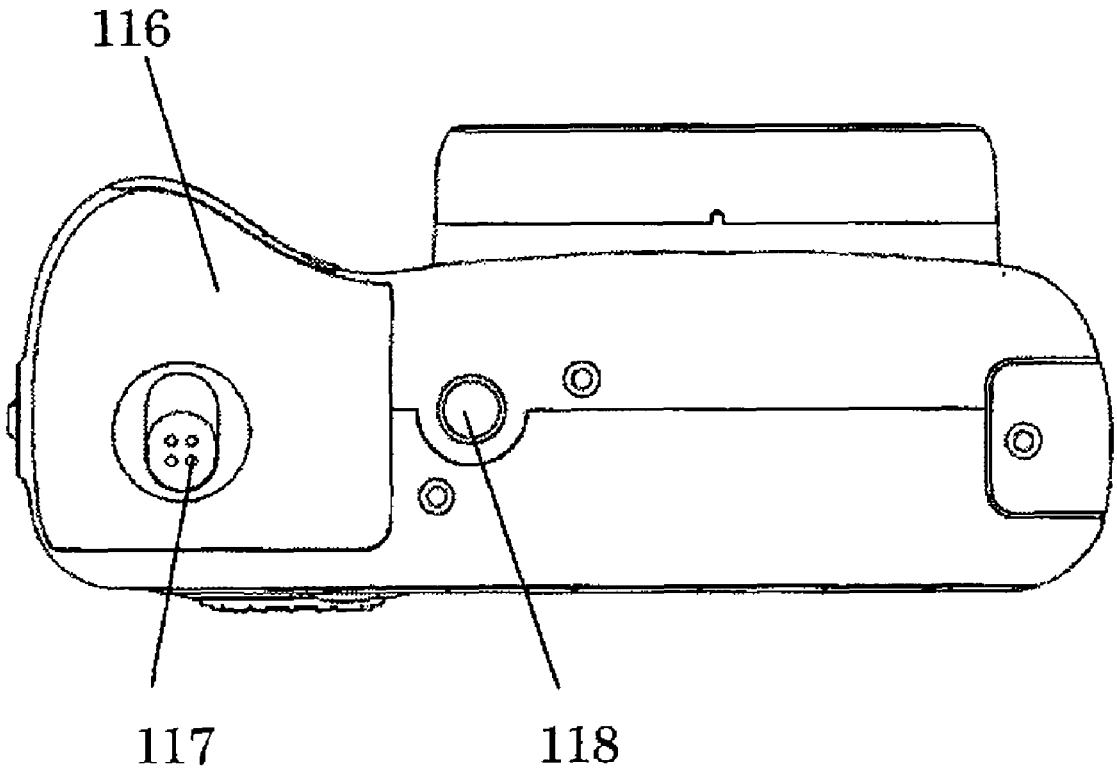
FIG. 3 is a bottom view of the digital camera shown in FIG. 1.
Figure 4:
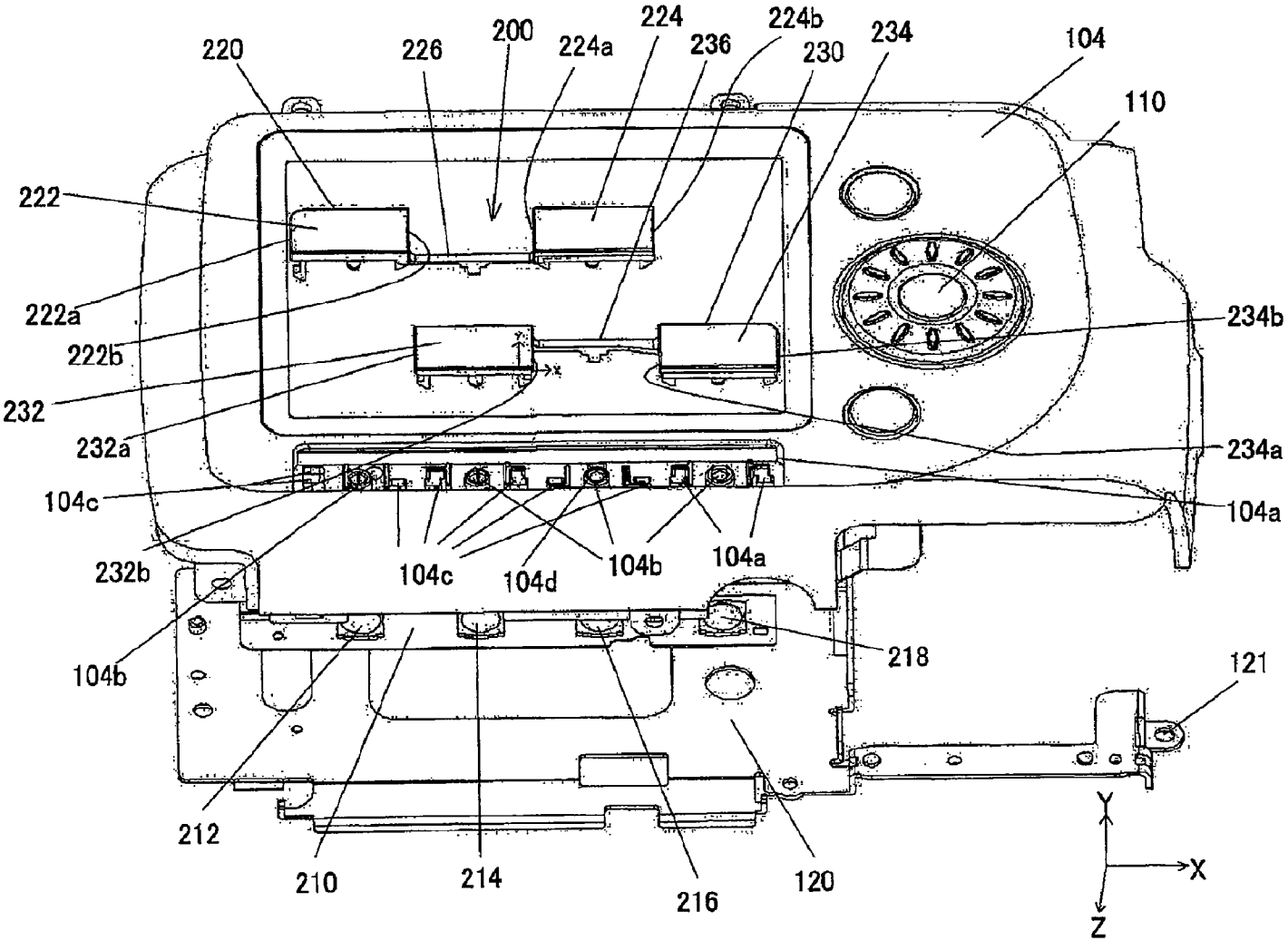
FIG. 4 is an exploded perspective view of the digital camera shown in FIG. 1 at its rear surface side.

FIG. 1 is a perspective view of a digital camera 100 on its front surface side according to a first embodiment of the present invention. FIG. 2 is a perspective view of the digital camera 100 on its rear surface side. FIG. 3 is a bottom view of the digital camera 100. FIG. 4 is an exploded perspective view of the digital camera on its rear surface side. As shown in FIG. 2, an X direction, a Y direction, and a Z direction are set to a length direction, a height direction, and a width direction of the digital camera 100. The X direction, the Y direction, and the Z direction are orthogonal to each other.

101 denotes a barrel of a taking optical system. 102 denotes an upper cover that covers a top of the camera. 103, 104, and 105 denote a front cover, a back cover, and a side cover, respectively. 106 denotes a connector cover that protects terminals mounted on a board.

As shown in FIG. 4, the rear surface cover (housing) 104 has concaves 104*a* with an approximately rectangular pole shape. The concave 104*a* accommodates at least part of the electronic apparatus 200, or button units 220 and 230, which will be described later. A board 210 of the electronic apparatus 200, which will be described later, is fixed under the concaves 104*a*. The concave 104*a* includes a bottom surface parallel to the XY plane, and four side surfaces each of which extends in the Z direction. The concave 104*a* has four cylindrical holes 104*b*, nine rectangular pole shaped holes 104*c*, and two rectangular pole shaped holes 104*d*.

Each hole 104*b* is provided at the center of the concave 104*a* in the Y direction, serves as a perforation hole that extends in the Z direction, and guides a switch compression part, which will be described later to a corresponding switch. Four holes 104*b* are arranged in the X direction at regular intervals. Two holes 104*c* are provided in the Y direction only at the left end of the concave 104*a*, although the remaining seven holes 104*c* are provided at the center of the concave 104*a* in the Y direction, and serve as perforation holes that extend in the Z direction. An engagement part, which will be described later, is inserted into the hole 104*c*. The seven holes 104*c* are arranged in the X direction at regular intervals. The holes 104*d* are provided on the lower side (not shown) in the Y direction of the second hole 104*a* from the left in FIG. 4, and on the upper side in the Y direction of the third hole 104*a* from the left. A projection of the connection part, which will be described later, is inserted into the hole 104*d*.

107 denotes a pop-up flash, which is movable relative to the camera body between an accommodation state shown in FIGS. 1 and 2 and a standing state (not shown). 108 denotes an auto focus ("AF") supplemental light window, and 109 denotes a liquid crystal display that displays various types of information of confirmation, reproduction, and taking conditions of the captured image. 110 denotes an operational dial that includes a central operation button and a peripheral dial, and is movable and compressible at four, i.e., upper, lower, left, and right, portions.

111 denotes a strap ring having a hole around which a strap is wound. 113 denotes a so-called release operation button having a photography preparation function and a photography starting function. 112 denotes a zoom lever for a magnification adjustment used for an optical power-variation function or a digital power-variation function, and is configured movable around the release operation button 113. 114 denotes a power operation button that turns on or off the camera body. 115 denotes a mode dial that selects various photography modes. 116 denotes a battery lid that can slide and rotate relative to the camera body. 117 denotes a battery lid lock lever that restrains unintentional sliding of the battery lid 116. 118 denotes a tripod hole used to fix the camera body on the tripod.

The digital camera 100 includes an electronic apparatus 200, as shown in FIG. 4. The electronic apparatus 200 arranges plural operation buttons in a row, configures each switch on the board to be compressed by each operation button, and includes a board 210 and a pair of button units 220 and 230.

The board 210 is held on a chassis 120 fixed into the camera body via screw holes 121, and made of a hard printed board or flexible printed board. The board 210 has four (electric) switches 212, 214, 216 and 218 corresponding to the number of operation buttons. The board 210 has a stripe shape that extends in the X direction. The switches 212 to 218 have circular shapes arranged at regular intervals in the X direction. As described later, the switches 212 to 218 turn on when the operation button is compressed, and turn off when the compression is released.

A (first) button unit 220 includes a conductor 221, a pair of operation buttons 222 and 224, and a connection part 226. A (second) button unit 230 includes a pair of operation buttons 232 and 234, and a connection part 236.

The conductor 221 is fixed onto the operation button 222 via adhesives. When a certain function is selected, a light emission element, such as a light emitting diode ("LED"), under the conductor 221 emits the light and informs the user of a selection of the function.

A pair of operation buttons 222 and 224 are spaced in the X direction, and the pair of operation buttons 232 and 234 are spaced in the X direction. The operation buttons 222, 224, 232, and 234 are compressed when the user sets up a photography condition, etc.

Assume that $L_{11}$ is a length of the operation button 222 in the X direction or a distance between the end surface 222*a* and the end surface 222*b* of the operation button 222, and $L_{12}$ is a length of the operation button 224 in the X direction or a distance between the end surface 224*a* and the end surface 224*b* of the operation button 224. $L_{13}$ is an interval between the operation buttons 222 and 224 in the X direction or a distance between the end surface 222*b* of the operation button 222 and the end surface 224*a* of the operation button 224. Similarly, assume that $L_{21}$ is a length of the operation button 232 in the X direction or a distance between the end surface 232*a* and the end surface 232*b*, and $L_{22}$ is a length of the operation button 234 in the X direction or a distance between the end surface 234*a* and the end surface 234*b* of the operation button 234. $L_{23}$ is an interval between the operation buttons 232 and 234 in the X direction or a distance between the end surface 232*b* of the operation button 232 and the end surface 234*a* of the operation button 234). Then, $L_{11}=L_{12}=L_{21}=L_{22}=L$, $L_{13}=L_{23}\approx L$ are met.

Thus, each of the operation buttons 222, 224, 232, and 234 has the same length of L in the X direction. The interval between the operation buttons 222 and 224, and the interval between the operation buttons 232 and 234 are equal to each other but slightly greater than L. Each of the operation buttons 222, 224, 232, and 234 have the same width of H in the Y direction. Each of the operation buttons 222, 224, 232, and 234 have approximately the same shape when viewed from the top although the operation buttons 222 and 234 have chamfers 222*c* and 234*c* at their corners.

Figure 5:
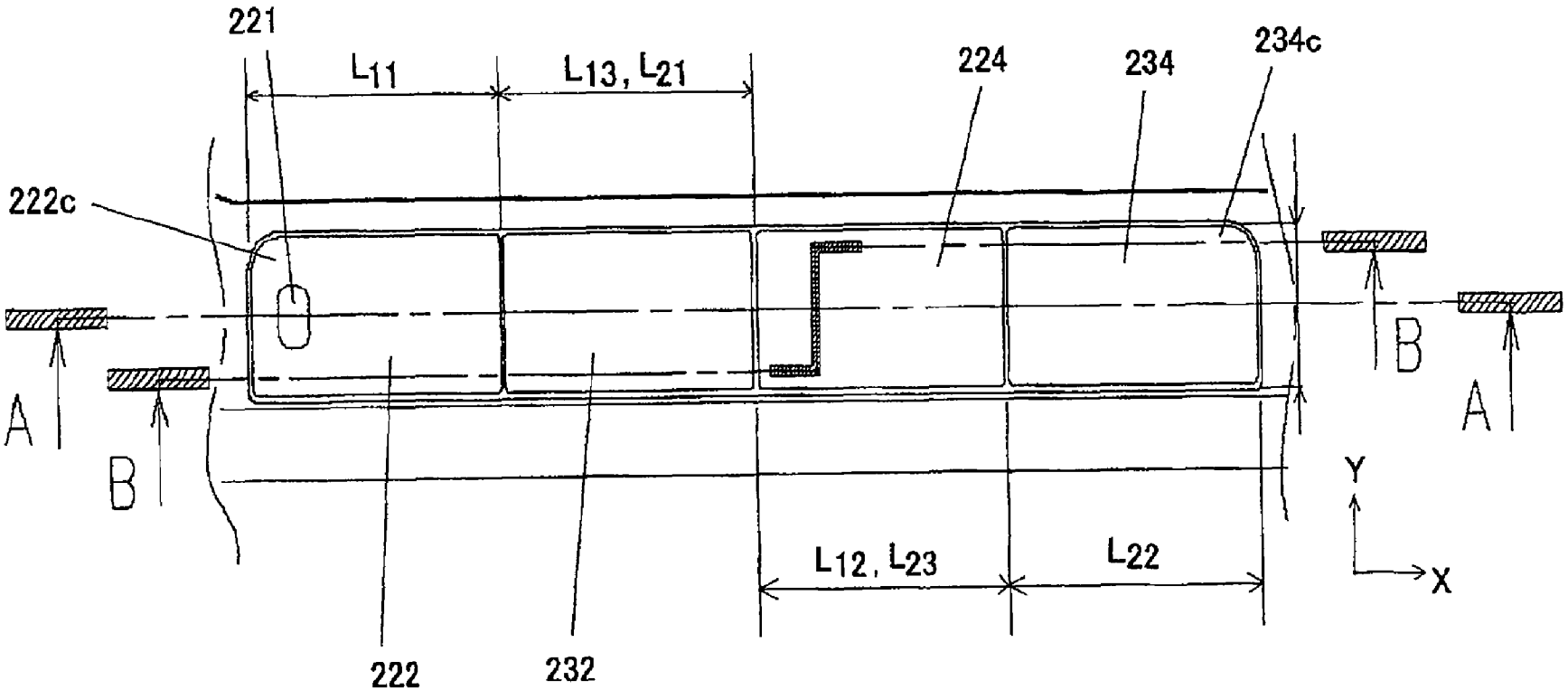
FIG. 5 is a partially enlarged plane view of the digital camera shown in FIG. 2.

This embodiment combines the button units 220 and 230 with each other in mounting the electronic apparatus 200 on the digital camera 100. In assembly, the operation buttons 222 and 224 of the button unit 220 and the operation buttons 232 and 234 of the button unit 230 are alternate in the X direction. In other words, as shown in FIG. 5, the operation buttons are alternate in order of 222, 232, 224, and 234 in the X direction. FIG. 5 is an enlarged plane view showing an arrangement of the operation buttons 222, 224, 232 and 234 of the button units 220 and 230 in the electronic apparatus 100.

Figure 6:
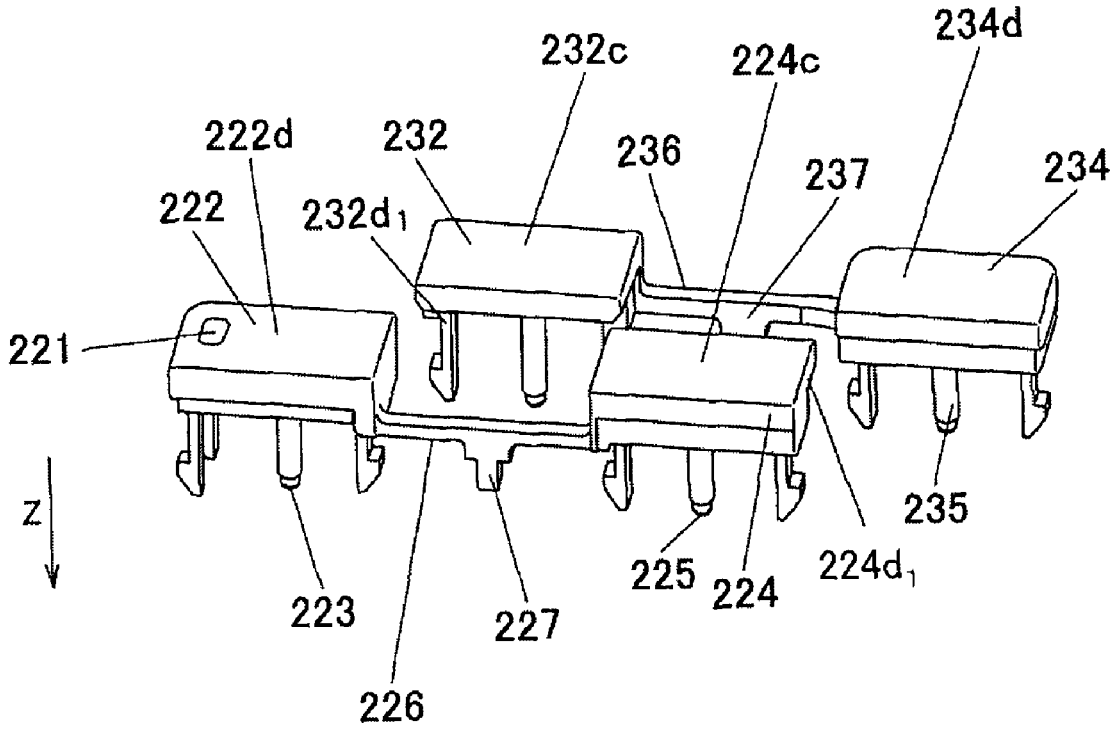
FIG. 6 is a perspective view of button units of the digital camera shown in FIG. 4 on its front surface side.
Figure 7:
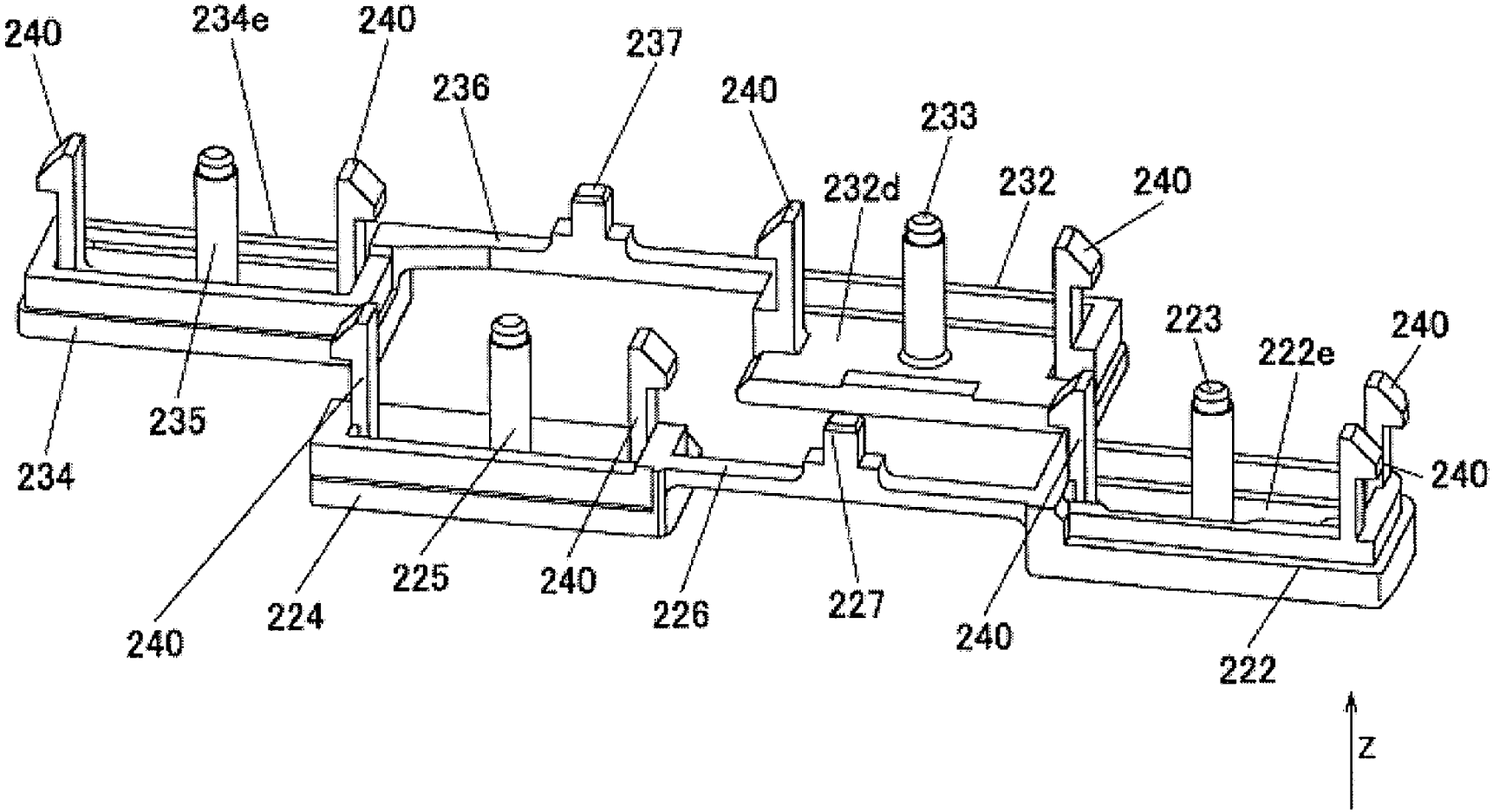
FIG. 7 is a perspective view of the button units shown in FIG. 6 at the rear surface side.
Figure 8:
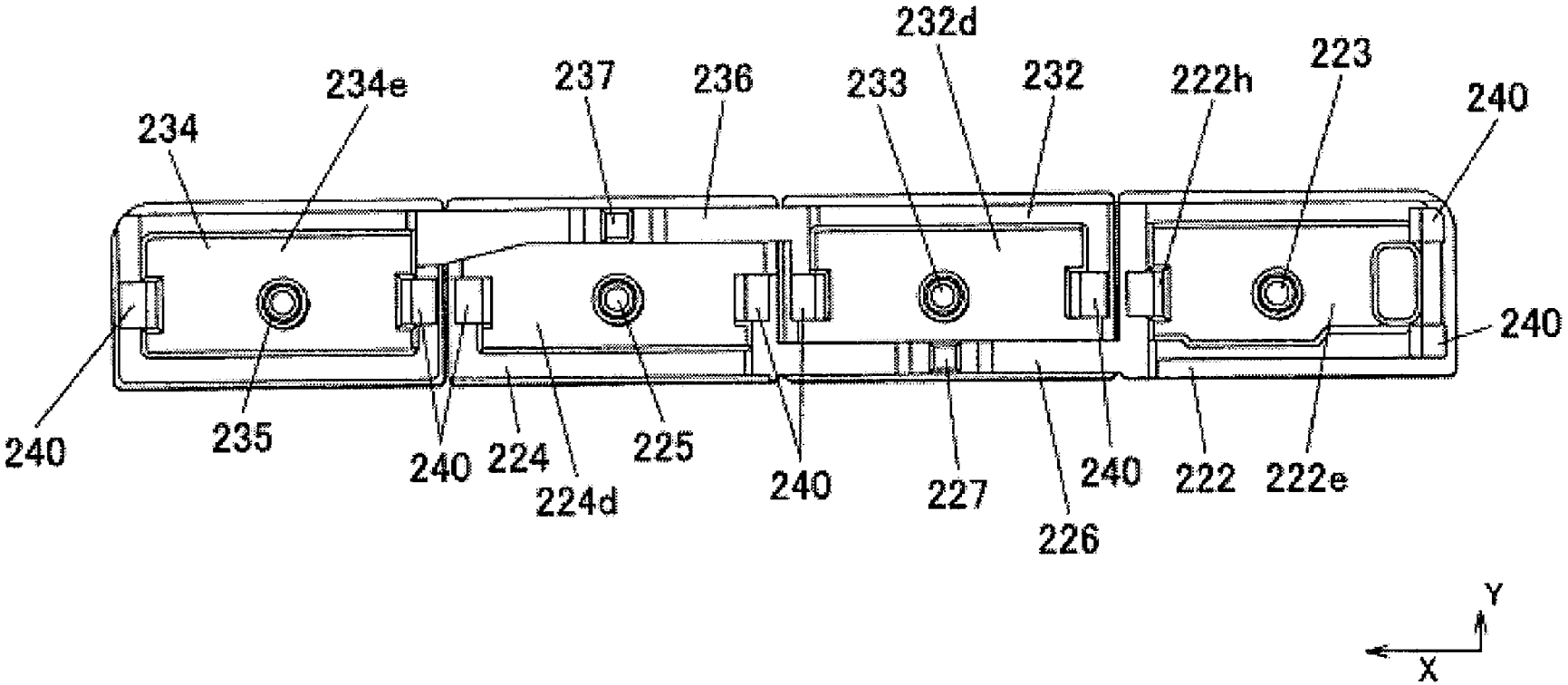
FIG. 8 is an enlarged bottom view of the button unit shown in FIG. 5.
Figure 9:
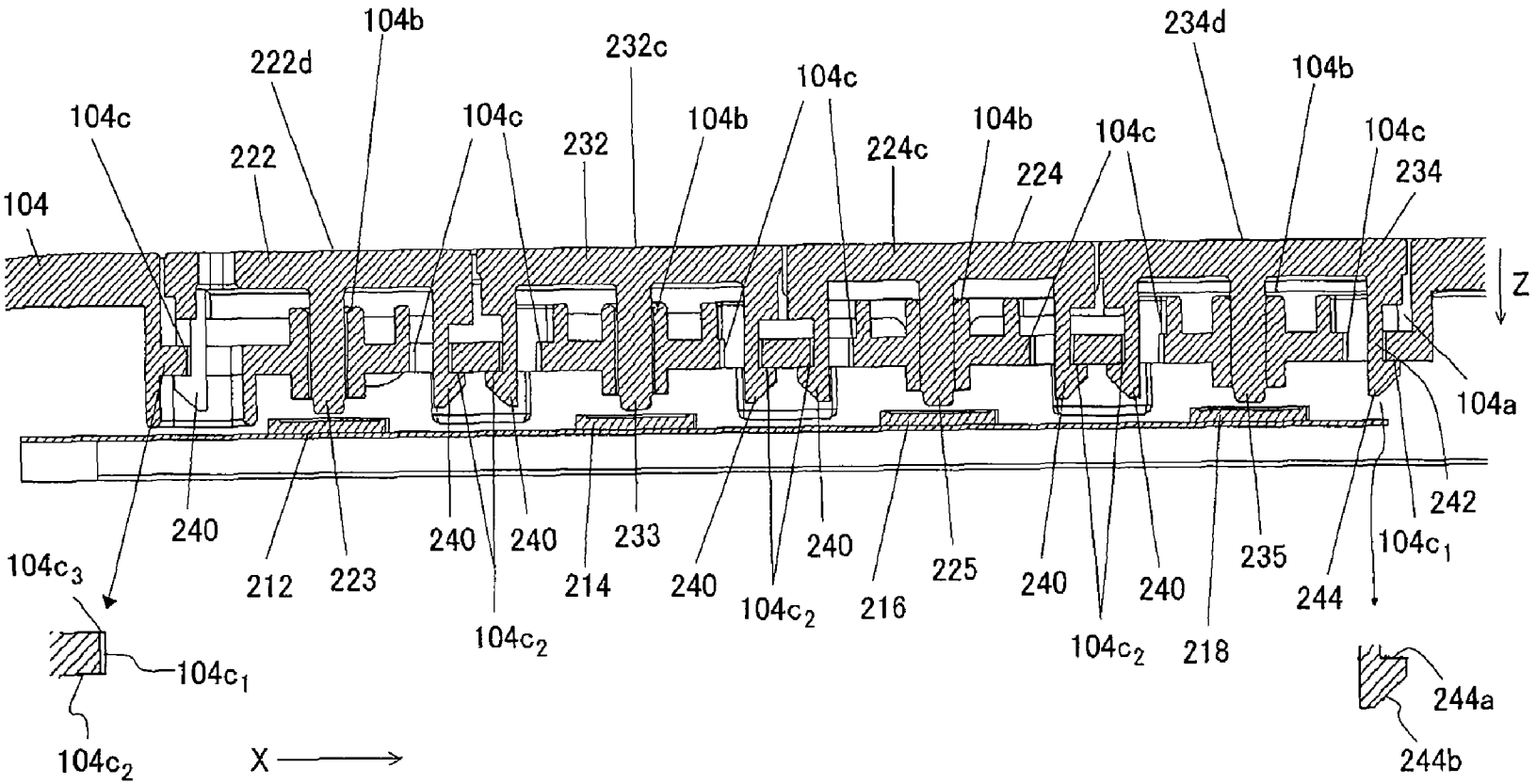
FIG. 9 is a sectional view taken along a line A-A in FIG. 5.
Figure 10:
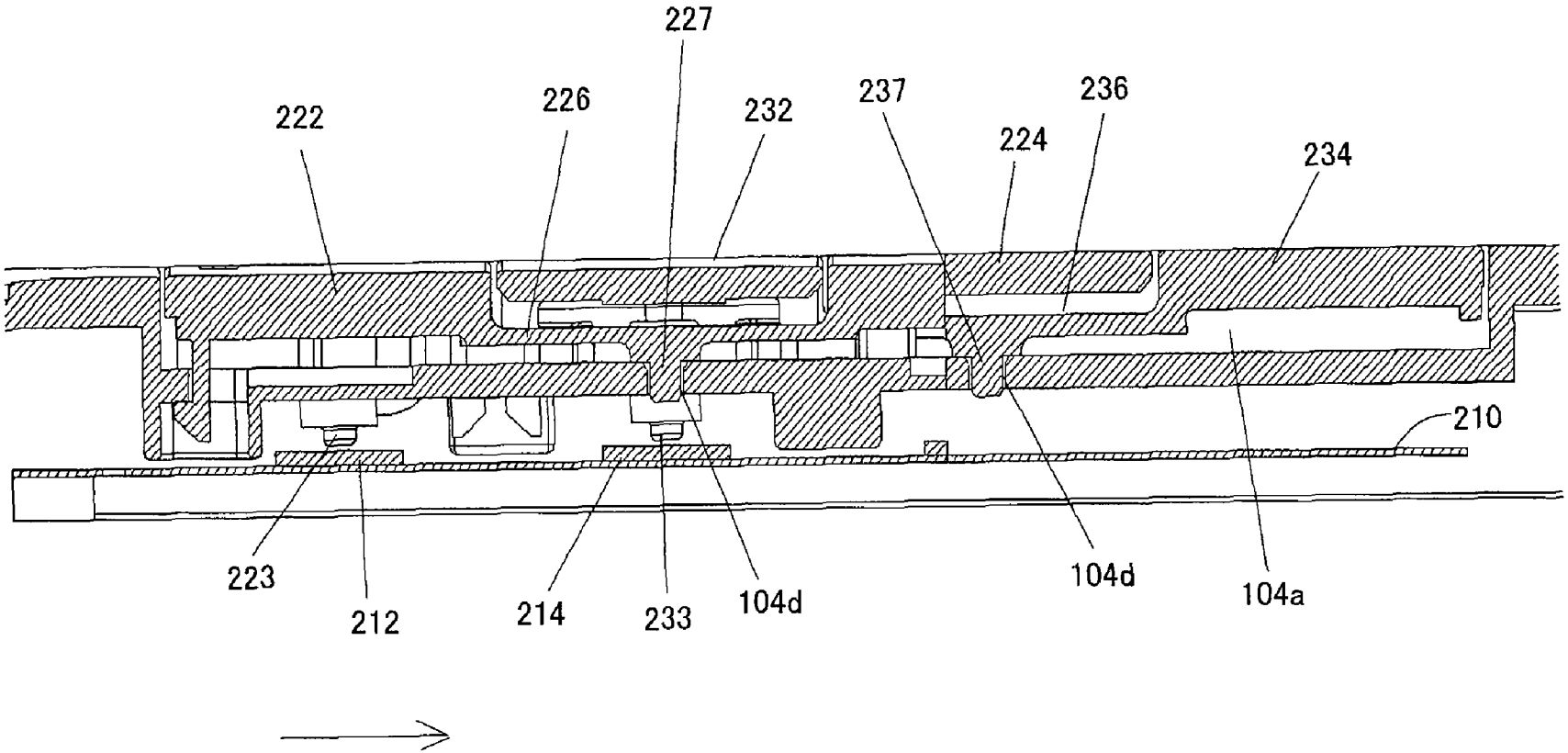
FIG. 10 is a sectional view taken along a line B-B in FIG. 5.

FIG. 6 is an exploded perspective view of the button units 220 and 230 of the electronic apparatus 100 on the front surface side. FIG. 7 is an exploded perspective view of the button units 220 and 230 of the electronic apparatus 100 on the rear surface side. FIG. 8 is an enlarged bottom view of the button units 220 and 230 of the electronic apparatus 100. FIG. 9 is a sectional view taken along line A-A in FIG. 5. FIG. 10 is a sectional view taken along line B-B in FIG. 5.

The operation button 222 includes a flat top surface (key top) 222*d* as a compressed surface, a bottom surface 222*e* as a rear surface of the key top 222*d*, a switch compression part 223, and an engagement part 240. The switch compression part 223 is provided at the center of the bottom surface 222*e*, and is configured to extend perpendicular to the key top 222*d* and to compress the switch 212. The engagement parts 240 are provided at two corners on the side of the end surface 222*a* of the bottom surface 222*e*, and at the central edge on the side of the end surface 222*b*. Only the operation button 222 has two engagement parts 240 on the side of the end surface 222*a*, but the present invention is not limited to this embodiment.

The operation button 224 includes a flat top surface (key top) 224*c* as a compressed surface, a bottom surface 224*d* as a rear surface of the key top 224*c*, a notch $\mathbf{224}d_1$, a switch compression part 225, and an engagement part 240. The notch $\mathbf{224}d_1$ is provided on the upper side in the Y direction of the bottom surface 224*d*, and extends in the X direction. The switch compression part 225 is provided at the center of the bottom surface 224*d*, and is configured to extend perpendicular to the key top 224*c* and to compress the switch 216. The engagement part 240 is provided at the central edge on the side of the end surface 224*a* of the bottom surface 224*d*, and at the central edge on the side of the end surface 224*b*.

The operation button 232 includes a flat top surface (key top) 232*c* as a compressed surface, a bottom surface 232*d* as a rear surface of the key top 232*c*, a notch $\mathbf{232}d_1$, a switch compression part 233, and an engagement part 240. The notch $\mathbf{232}d_1$ is provided on the lower side in the Y direction of the bottom surface 232*d*, and extends in the X direction. The switch compression part 233 is provided at the center of the bottom surface 232*d*, and is configured to extend perpendicular to the key top 232*c* and to compress the switch 214. The engagement part 240 is provided at the central edge on the side of the end surface 232*a* of the bottom surface 232*d*, and at the central edge on the side of the end surface 232*b*.

The operation button 234 includes a flat top surface (key top) 234*d* as a compressed surface, a bottom surface 234*e* as a rear surface of the key top 234*d*, a switch compression part 235, and an engagement part 240. The switch compression part 235 is provided at the center of the bottom surface 234*e*, and is configured to extend perpendicular to the key top 234*d* and to compress the switch 218. The engagement part 240 is provided at the central edge on the side of the end surface 234*a* of the bottom surface 234*e*, and at the central edge on the side of the end surface 234*b*.

Each switch compression part has an approximately cylindrical shape, and its tip is chamfered or tapered. Each switch compression part is inserted into a corresponding hole 104*b* of the rear surface cover 104, and is located above the corresponding switch. As a result, when a user presses one of the operation buttons, a corresponding switch is pressed and turned on via a corresponding switch compression part. The switch turns off when a corresponding operation button is pressed again or another button, such as the operation dial 110, is pressed.

Since the hole 104*b* of the rear surface cover 104 guides the corresponding switch compression part in the Z direction when the operation button is pressed, and improves the reliability of the switch compressing action. The hole 104*b* restricts a movement of each operation button in the XY directions, and consequently makes uniform an aperture of each key top relative to the rear surface cover 104, preventing a collision between the end surface of the operation button and the rear surface cover 104, and improving the operability of each operation button.

Each engagement part 240 includes, as shown in FIG. 9, a support member 242 having a rectangular pillar shape that extends in the Z direction, and a claw 244 having a triangular pole (hook shape) with a rectangular equilateral triangle at its top. Each claw 244 includes an end surface 244*a* parallel to the key top of each operation button, and a bevel surface 244*b*. The bevel surface 244*b* in each operation button faces outside.

Each engagement part 240 is inserted into the hole 104*c* in the concave 104*a* of the rear surface cover 104. As shown in FIG. 9, the hole 104*c* is defined by an end surface $\mathbf{104}c_1$ that extends in the Z direction, a rear surface $\mathbf{104}c_2$ of the concave 104*a* near the hole 104*c*, and an upper edge part $\mathbf{104}c_3$. At the insertion time, the bevel surface 244*b* of the claw 244 of each engagement part 240 contacts the upper edge part $\mathbf{104}c_3$ of the hole 104*c*, and proceeds through the hole 104*c*. At that time, the support member 242 gradually bends in the X direction or −X direction. After the insertion is completed, the support member 242 returns to the original state, and contacts or becomes ready to contact the end surface $\mathbf{104}c_1$ of the hole 104*c* in the Z direction. In addition, the end surface 244*a* is engaged with the rear surface $\mathbf{104}c_2$, and this engagement restricts the movements of the button units 220 and 230 in the −Z direction, and prevents the rear surface cover 104 from dropping. Moreover, each operation button has the engagement parts 240 at both sides in the X direction. The movements of each operation button in the X direction and −X direction are restricted at both sides in the X direction, because the support member 242 of the engagement part 240 contacts or becomes ready to contact the end surface $\mathbf{104}c_1$ of the hole 104.

As shown in FIG. 9, each operation button has the same height, and the key tops 222*d*, 224*c*, 232*c*, and 234*d* form the same plane as the top surface of the rear surface cover 104. Therefore, a user does not hook any operation button, and the operability improves by preventing the malfunction.

The connection part 226 is provided between two operation buttons 222 and 224, and connects them to each other while maintaining them apart from each other. The connection part 226 returns the pressed operation button by the elastic force. The connection part 226 is an arm member that extends in the X direction. One end of the connection part 226 is connected to the end surface 222*b* in the X direction of the operation button 222, and the other end of the connection part 226 is connected to the end surface 224*a* in the X direction of the operation button 224.

The connection part 236 is located between two operation buttons 232 and 234, and connects them to each other while maintaining them apart from each other. The connection part 236 returns the pressed operation button by the elastic force. The connection part 236 is an arm member that extends in the X direction. One end of the connection part 236 is connected to the end surface 232*b* in the X direction of the operation button 232, and the other end of the connection part 236 is connected to the end surface 234*a* in the X direction of the operation button 234.

Thus, the connection part 226 falls within a length H in the Y direction of a pair of operation buttons 222 and 224, and the connection part 236 falls within a length H in the Y direction of a pair of operation buttons 232 and 234. The connection parts 226 and 236 do not extend in the Y direction unlike the support member in JP 10-294044, or extend beyond the length of the operation button in the Y direction unlike the base in JP 10-294044, thereby making the button units 220 and 230 small in the Y direction.

As shown in FIG. 5, when the button units 220 and 230 are combined and arranged, the connection part 226 is arranged below another operation button 232 that is arranged between the operation buttons 222 and 224. In addition, the connection part 236 is arranged below another operation button 224 that is arranged between the operation buttons 232 and 234. In other words, the connection part 226 of the button unit 220 that is one of the two operation button units 220 and 230 is arranged below the operation button 232 of the other button unit 230. In addition, the connection part 236 of the button unit 230 that is the other of the two operation button units 220 and 230 is arranged below the operation button 224 of the other button unit 220. When viewed from the upper side in the Z direction, the connection parts 226 and 236 does not project to the outside of the operation buttons 222, 224, 232, and 234, as shown in FIG. 5, making the length in the Y direction smaller than that in JP 10-294044.

As discussed above, each operation button is provided with the switch compression part, and the connection parts 226 and 236 are configured to avoid it. In that case, when two connection parts are provided at the same side with respect to the switch compression in the Y direction part, they interfere with each other. Accordingly, as shown in FIG. 8, the connection parts 226 and 236 of the two button units 220 and 230 are arranged at the opposite side with respect to a direction that passes the centers of the switch compression parts 223, 233, 225, and 235, and is parallel to the row direction (X direction) of the operation buttons.

This embodiment provides the connection part 226 lower than the switch compression part 233 in the Y direction, and connection part 236 upper than the switch compression part 225 in the Y direction. In this embodiment, the connection part 226 is located at the notch 232$d_1$ of the bottom surface 232*d* of the operation button 232, and the connection part 236 is located at the notch 224$d_1$ of the bottom surface 224*d* of the operation button 224. It is understood from FIG. 6 that a side of the operation button 224 on which the notch 224$d_1$ is provided is opposite to a side of the operation button 224 at which the connection part 226 is connected, with respect to the switch compression part 225. Similarly, it is understood that a side of the operation button 232 on which the notch 232$d_1$ is provided is opposite to a side of the operation button 232 at which the connection part 236 is connected, with respect to the switch compression part 233.

The connection part 226 has an approximately rectangular pole shape, and includes, at its center, a projection 227 that extends in the Z direction or in a direction perpendicular to the key tops 222*d* and 224*c*. Similarly, the connection part 236 has an approximately rectangular pole shape, and includes, at its center, a projection 237 that extends in the Z direction or in a direction perpendicular to the key tops 232*c* and 234*d*. The projections 227 and 237 each have a rectangular pole shape.

As shown in FIG. 10, the projections 227 and 237 are inserted into the holes 104*d* in the rear surface cover 104, and fixed there. The operation button 222 can move in the Z direction due to the elastic force between the projection 227 of the connection part 226 and the connection part of the end surface 222*b*, and the operation button 222 can return to the original position when the operation button 222 is pressed. The operation button 224 can move in the Z direction due to the elastic force between the projection 227 of the connection part 226 and the connection part of the end surface 224*a*, and the operation button 224 can return to the original position when the operation button 224 is pressed. Similarly, the operation button 232 can move in the Z direction due to the elastic force between the projection 237 of the connection part 236 and the connection part of the end surface 232*b*, and the operation button 232 can return to the original position when the operation button 232 is pressed. The operation button 234 can move in the Z direction due to the elastic force between the projection 237 of the connection part 236 and the connection part of the end surface 234*a*, and the operation button 234 can return to the original position when the operation button 234 is pressed.

While a pair of button units 220 and 230 are being attached to the rear surface cover 104, the projections 227 and 237 and the holes 104*d* fall within the plane of the operation buttons 232 and 224, as shown in FIG. 5, when viewed from the upper side in the Z direction. This configuration can make small the electronic apparatus 200 in the Y direction.

In operation, when the operation button is pressed, the switch compression part is guided by the hole 104*b* and presses the switch. The pressed operation button returns to the original position due to the elastic force between the projection of the connection part and the connection part of the corresponding operation button. The electronic apparatus 100 is made small in the Y direction since there is no member between the base and the support member, unlike the JP 10-294044. In addition, the projection of the case is not inserted into the base unlike JP 10-294044, a deformation of each component can be provided. Moreover, since no adhesives are used unlike JP 10-294044 that uses the adhesive to fix the base and the case, no adhesive peel-off occurs.

Second Embodiment

Figure 11:
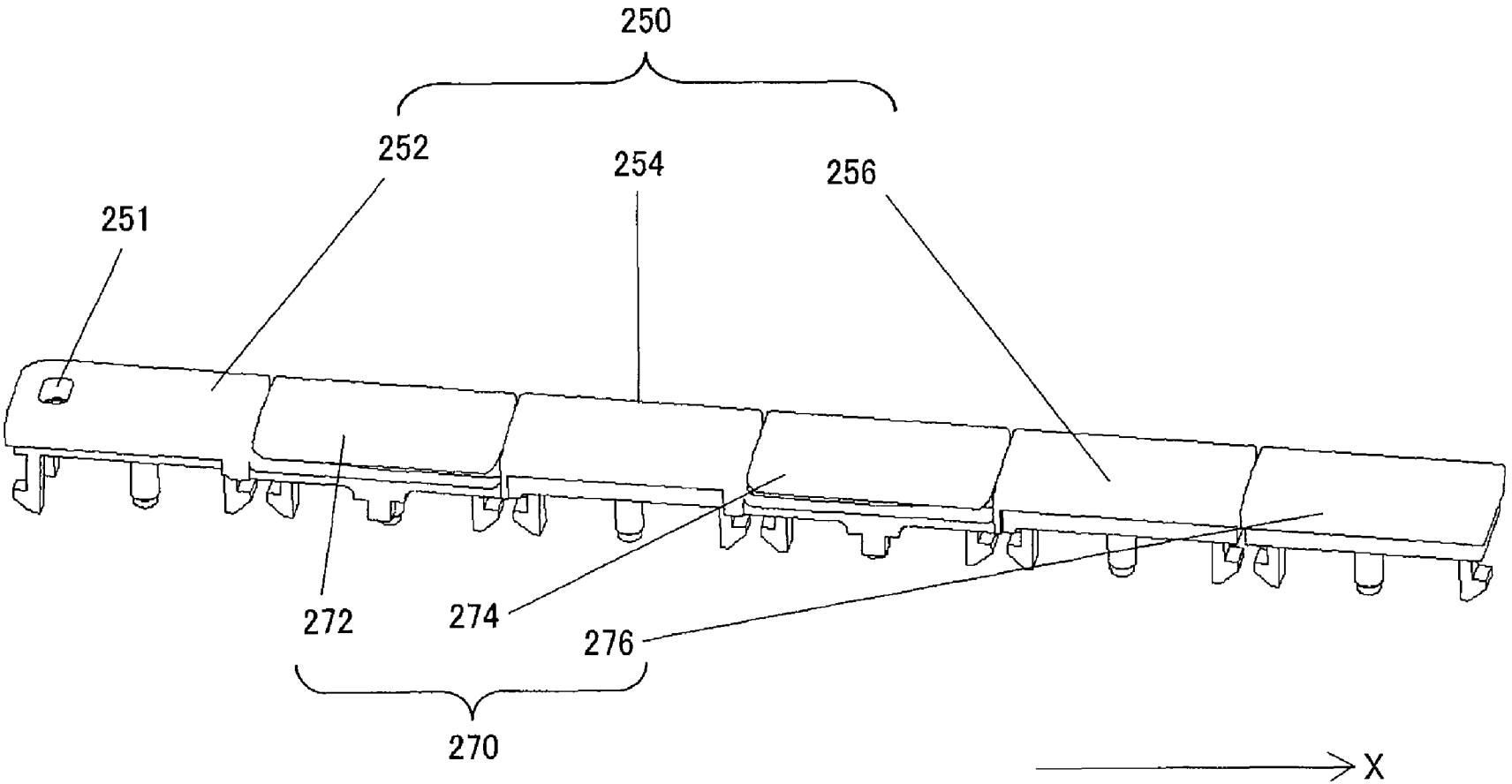
FIG. 11 is a perspective view of a combined and arranged button units applicable to an electronic apparatus according to a second embodiment of the present invention.
Figure 12:
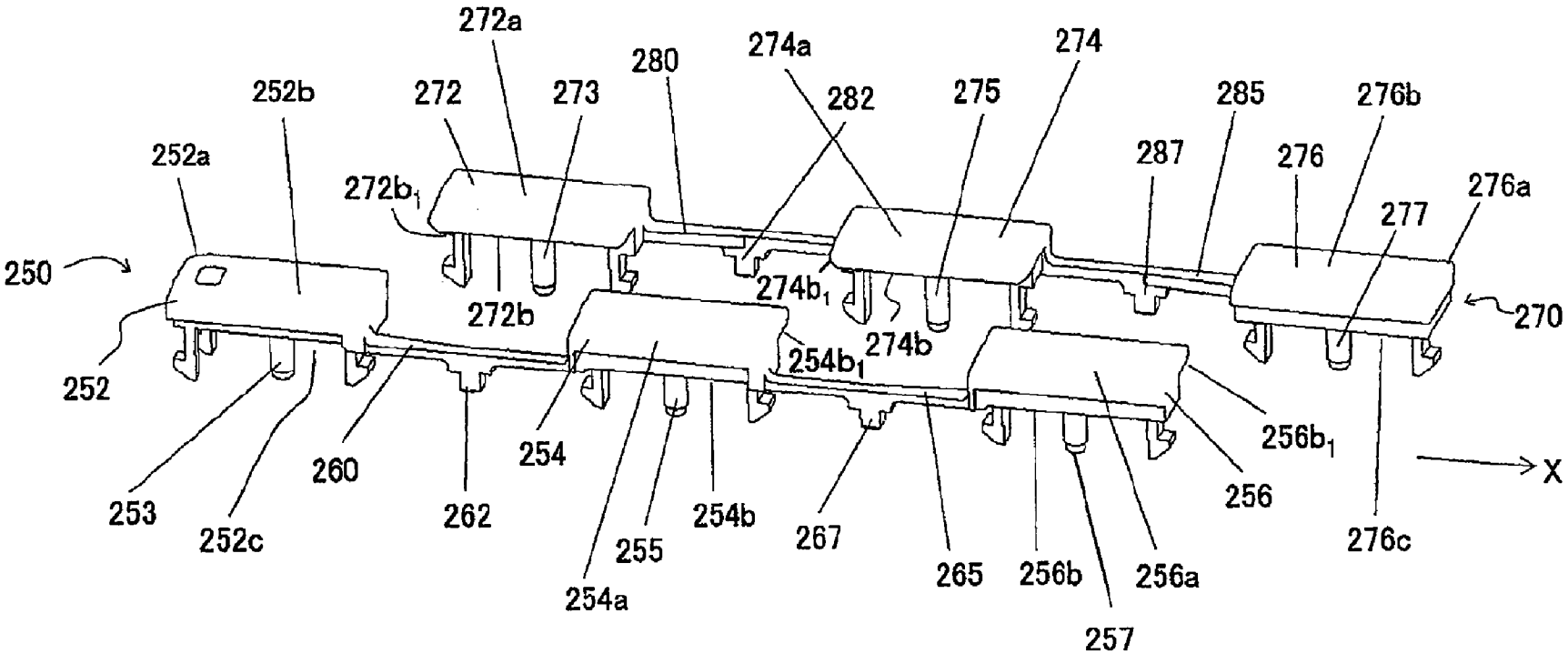
FIG. 12 is a perspective view of the button unit shown in FIG. 11 on the front side.
Figure 13:
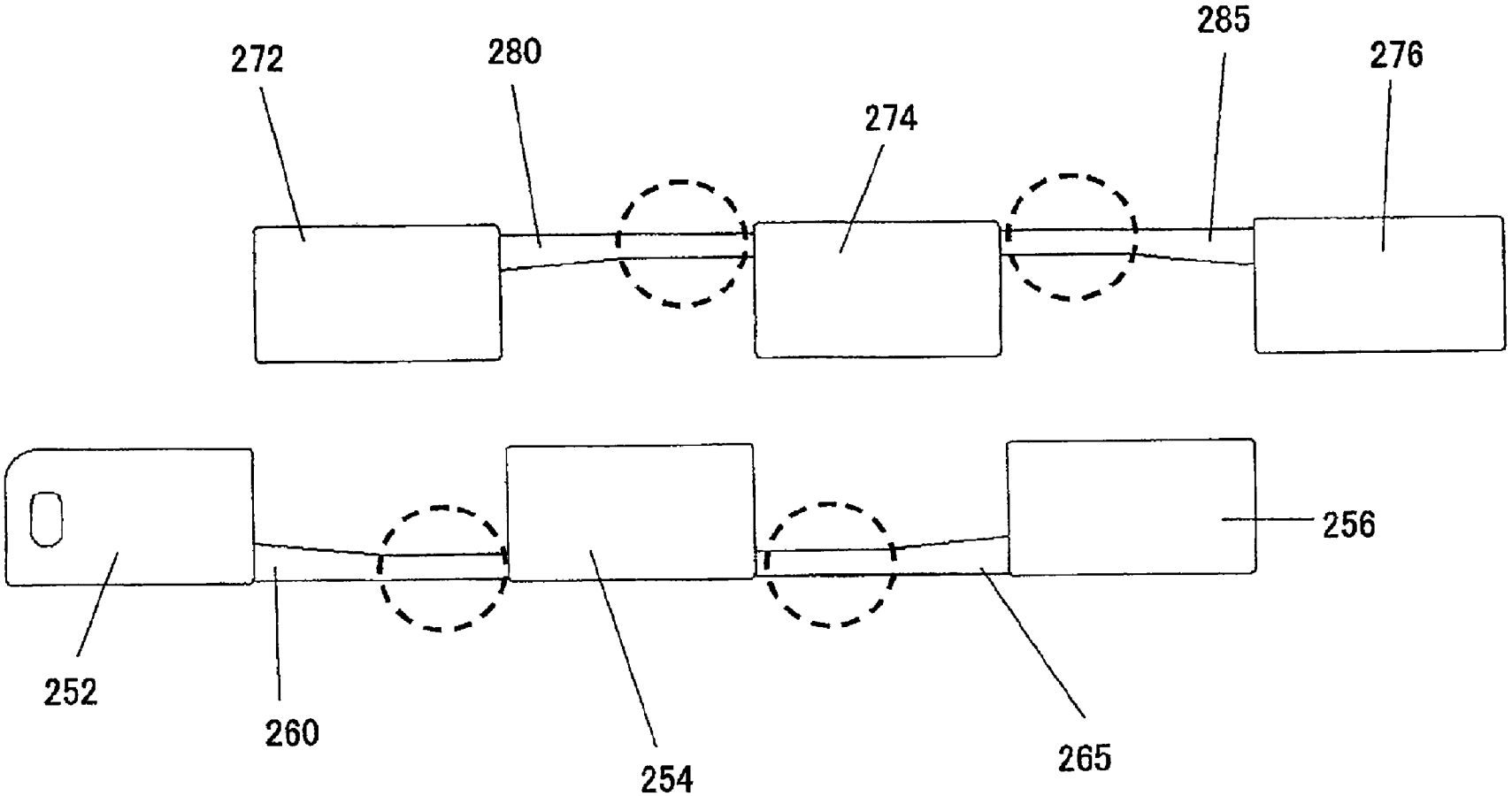
FIG. 13 is a top view of the button unit shown in FIG. 12.

FIG. 11 is a perspective view of an arrangement of combined button units 250 and 270 that are applicable to an electronic apparatus according to a second embodiment of the present invention. FIG. 12 is a perspective view of the button units 250 and 270 on a front side. FIG. 13 is a top view of the button units 250 and 270 shown in FIG. 12.

The (first) button unit 250 includes a conductor 251, three operation buttons 252, 254, and 256, and connection parts 260 and 265. The (second) button unit 270 includes three operation buttons 272, 274, and 276, and connection parts 280 and 285.

The conductor 251 is similar to the conductor 221. The three operation buttons 252, 254, and 256 are arranged at regular intervals in the X direction, and the three operation buttons 272, 274, and 276 are arranged at regular intervals in the X direction. Each button has a structure and function similar to those of the first embodiment. It is also similar that the operation buttons 252 and 276 have chamfered parts 252*a* and 276*a*. This embodiment also combines and arranges the button unit 250 and 270 so that their operation buttons can be alternately arranged in the X direction. As a result, as shown in FIG. 11, the operation buttons are arranged in order of 252, 272, 254, 274, 256, and 276 in the X direction.

The operation button 252 includes a key top 252*b*, a bottom surface 252*c*, and a switch compression part 253. The operation button 254 includes a key top 254*a*, a bottom surface 254*b*, a notch 254$b_1$, and a switch compression part 255. The operation button 256 includes a key top 256*a*, a bottom surface 256*b*, a notch 256$b_1$, and a switch compression part 257. The operation button 272 includes a key top 272*a*, a bottom surface 272*b*, a notch 272$b_1$, and a switch compression part 273. The operation button 274 includes a key top 274*a*, a bottom surface 274*b*, a notch 274$b_1$, and a switch compression part 275. The operation button 276 includes a key top 276*b*, a bottom surface 276*c*, and a switch compression part 277. The key top, the bottom surface, the notch, and the switch compression part have structures and functions similar to those of FIG. 1.

The connection part 260 is located between the two operation buttons 252 and 254, and connects them to each other while maintaining them apart from each other. The connection part 260 is an arm member that extends in the X direction, and has a projection 262 at its center that extends in the Z direction. The connection part 265 is located between the two operation buttons 254 and 256, and connects them to each other while maintaining them apart from each other. The connection part 265 is an arm member that extends in the X direction, and has a projection 267 at its center that extends in the Z direction. The connection part 280 is located between the two operation buttons 272 and 274, and connects them to each other while maintaining them away from each other. The connection part 280 is an arm member that extends in the X direction, and has a projection 282 at its center that extends in the Z direction. The connection part 285 is located between the two operation buttons 274 and 276, and connects them to each other while maintaining them away from each other. The connection part 285 is an arm member that extends in the X direction, and has a projection 287 at its center that extends in the Z direction. Each element of the connection part has a basic function similar to that of the first embodiment, but this embodiment adds an additional function to the connection part.

In the first embodiment, each operation button is connected to the connection part at its one end. On the other hand, in this embodiment, the operation buttons are classified into the (first) operation button 252, 256, 272 and 276 that are connected to the connection part only at one end, and the (second) operation buttons 254 and 274 that are connected to the connection parts at both ends. The operation button that is connected to the connection part at one end can be regarded as a cantilever, and the operation button that is connected to the connection parts at both ends can be regarded as a double-held beam. Assume that all the connection parts have the same shape. Then, the elastic force which the cantilever operation button receives is different from the elastic force which the double-held beam operation button receives, and the operability lowers due to the elastic force of the connection part because the operational feeling differs. Accordingly, this embodiment equalizes the operational feeling of each operation button by making larger a part of the connection part between the projection and the end connected to the first operation button than a part of the connection part between the projection and end connected to the second operation button.

This embodiment makes a width in the Y direction of each of the connection parts 260, 265, 280, and 285 at the double-held beam operation button 254 and 274 smaller than that at the cantilever operation buttons 252, 256, 272, and 276, as shown in dotted line in FIG. 13.

While this embodiment equalizes the operational force of each operation button by adjusting the width of the connection part in the Y direction, the present invention is not limited to this embodiment. A similar effect can be obtained by adjusting an arm thickness, or a position on the fulcrum point on the arm.

Figure 14:
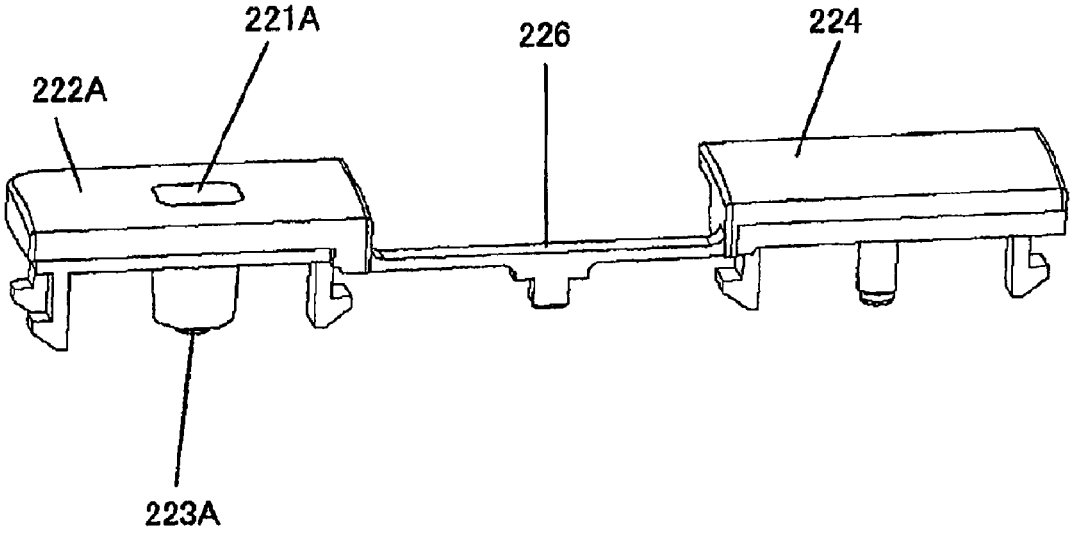
FIG. 14 is a perspective view of a variation of the button unit shown in FIG. 4.
Figure 15:
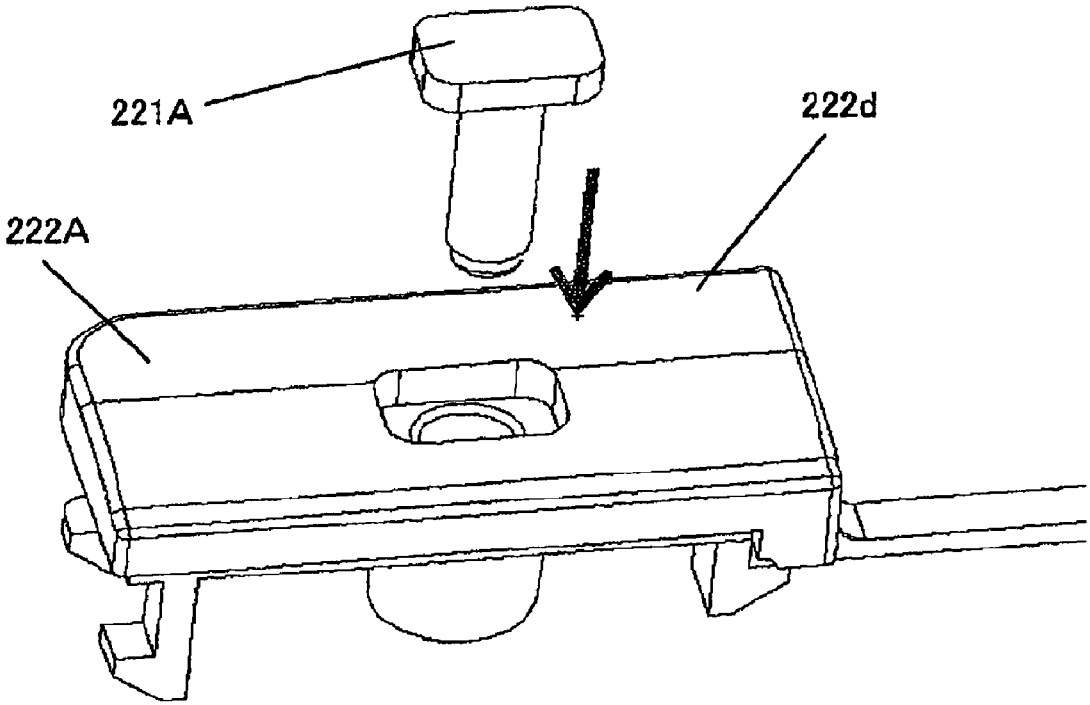
FIG. 15 is a partially enlarged perspective view of FIG. 14.
Figure 16:
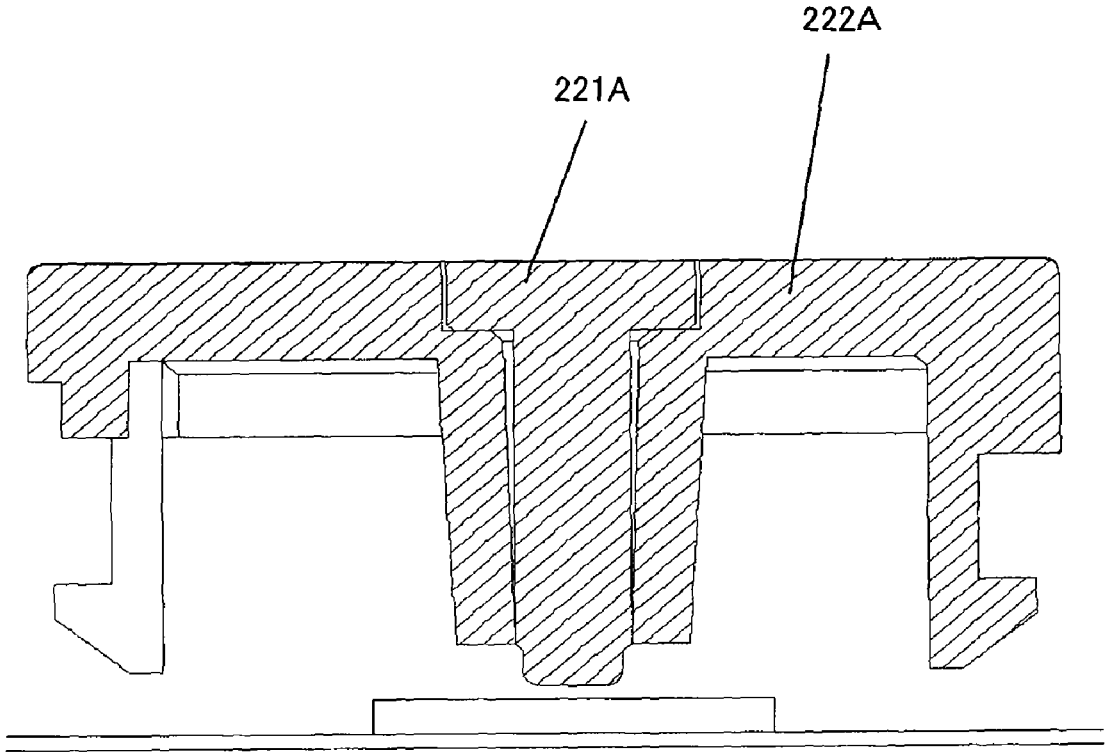
FIG. 16 is a partially enlarged perspective view of FIG. 14.

In addition, when the conductor 221A is located at the center of the operation button 222A as shown in FIG. 14, the switch compression part 223A may serve as the conductor 221A. At this time, as shown in FIGS. 15 and 16, the conductor 221A can be inserted into the top surface 222*d* of the operation button 222A and integrated with it. Then, the peel-off risk of the conductor 221A reduces when the operation button 222A is pressed. Furthermore, when the operation button part covers from the vicinity of the switch compression part to the vicinity of the outer surface of the conductor 221A as shown in FIG. 16, the light leakage to the surrounding reduces.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. For example, the electronic unit applicable to the present invention is not limited to a digital camera, and is applicable to a cellular phone, personal digital assistant ("PDA"), a laptop personal computer ("PC"), a game machine, etc.

This application claims the benefit of Japanese Patent Application No. 2007-208728, filed Aug. 10, 2007, which is hereby incorporated by reference herein in its entirety.

What is claimed is:

1. An electronic apparatus comprising:

plural operation buttons, through which each switch on a board can be compressed; and a connection part configured to connect two operation buttons out of the plural operation buttons with each other while maintaining the two operation buttons apart from each other, and to return a compressed operation button through an elastic force, wherein the connection part is arranged below an operation button that is located between the two operation buttons among the plural operation buttons, wherein each operation button includes a key top as a compressed surface, and a switch compression part that extends perpendicular to the key top and is configured to compress the switch, and wherein the switch compression part is integrated with a conductor configured to guide light from a light emission element.

2. The electronic apparatus according to claim 1, wherein the operation button arranged between the two operation buttons has a notch on a rear surface of the key top as a compressed surface, the connection part being located at the notch.

3. An electronic apparatus comprising:

plural operation buttons, through which each switch on a board can be compressed; and two button units each having at least two operation buttons and a connection part configured to connect two operation buttons out of the plural operation buttons with each other while maintaining the two operation buttons apart from each other, wherein the two button units are combined so that the operation buttons of each button unit are alternately arranged, and wherein a connection part of one of the two button units is located below one of the at least two operation buttons of the other button unit of the two button units, and a connection part of the other of the two button units is located below one of the at least two operation buttons of the one button unit of the two button units.

4. The electronic apparatus according to claim 3, wherein each operation button has a switch compression part that extends perpendicular to a key top as a compressed surface, and wherein the connection parts of the two button units are arranged on opposite sides with respect to a direction that passes a center of the switch compression part, and is parallel to a row direction of the operation buttons.

5. The electronic apparatus according to claim 3 further comprising:

a housing that accommodates at least part of the electronic apparatus, wherein each operation button includes a switch compression part that extends perpendicular to a key top as a compressed surface and is configured to compress the switch, and wherein the housing has a hole that guides the switch compression part to the switch.

6. The electronic apparatus according to claim 3 further comprising:

a housing that accommodates at least part of the electronic apparatus, wherein each operation button includes an engagement part that extends to a key top as a compressed surface, and wherein the housing has a hole, into which the engagement part is inserted.

7. The electronic apparatus according to claim 3 further comprising:

a housing that accommodates at least part of the electronic apparatus, wherein the connection part includes a projection that extends perpendicular to a key top as a compressed surface of the operation button, and wherein the housing has a hole, into which the projection of the connection part is inserted.

8. The electronic apparatus according to claim 7, wherein the plural buttons include a first operation button connected to the connection part only at one end, and a second operation button connected to the connection parts at both ends, wherein a part between the projection and an end of the connection part connected to the first operation button is larger than a part between the projection and an end of the connection part connected to the second operation button.

* * * * *